US009995071B2

(12) United States Patent
Kunz

(10) Patent No.: US 9,995,071 B2
(45) Date of Patent: Jun. 12, 2018

(54) SYSTEM AND METHOD FOR INHIBITING WINDOW SASH DRIFT

(71) Applicant: John Evans' Sons, Inc., Lansdale, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 0 days. days.

(21) Appl. No.: 15/093,727

(22) Filed: Apr. 7, 2016

(65) Prior Publication Data

US 2016/0298368 A1 Oct. 13, 2016

Related U.S. Application Data

(60) Provisional application No. 62/144,898, filed on Apr. 8, 2015.

(51) Int. Cl.

| | |
|---|---|
| ***E05F 1/02*** | (2006.01) |
| ***E05C 17/60*** | (2006.01) |
| ***E05C 17/46*** | (2006.01) |
| ***E05C 17/64*** | (2006.01) |
| ***E05D 13/00*** | (2006.01) |
| ***E05D 15/22*** | (2006.01) |

(52) U.S. Cl.

CPC ..... *E05D 13/04* (2013.01); *E05C 17/46* (2013.01); *E05D 13/08* (2013.01); *E05D 13/1276* (2013.01); *E05D 15/22* (2013.01); *E05Y 2201/46* (2013.01); *E05Y 2900/148* (2013.01)

(58) Field of Classification Search

CPC ..... E05D 13/04; E05D 13/06; E05D 13/08; E05D 13/1276; E05D 15/22; E05C 17/46; E05Y 2201/46

See application file for complete search history.

(56) References Cited

U.S. PATENT DOCUMENTS 4,506,407 A * 3/1985 Downey ..... E05C 17/28 16/320
4,878,265 A * 11/1989 Nesbitt ..... E05B 47/0002 16/49
4,953,258 A * 9/1990 Mennuto ..... E05D 13/1276 16/193
4,961,247 A * 10/1990 Leitzel ..... E05D 13/1276 16/193

(Continued)

*Primary Examiner* — Katherine W Mitchell
*Assistant Examiner* — Abe Massad
(74) *Attorney, Agent, or Firm* — LaMorte & Associates P.C.

(57) ABSTRACT

A system and method for inhibiting inadvertent movement of a window sash out of a fully open position. Brake shoes travel in the guide tracks as the window sash is moved between a fully open position and a fully closed position. A stop is mounted within the guide tracks. The brake shoe and the stop contact and interconnect when the window sash is moved to its fully open position. The brake shoe is separable from the stop when a closing force is manually applied to the window sash that acts to move the window sash away from its fully open position. The force applied must exceed a threshold level. In this manner, the window sash will remain in its fully open position and will not inadvertently drift closed due to gravity, vibrations or contact with another window sash.

10 Claims, 4 Drawing Sheets

(56) References Cited

U.S. PATENT DOCUMENTS

| | | | | |
|---|---|---|---|---|
| 5,906,026 | A * | 5/1999 | Junttila | E05C 17/28<br>16/65 |
| 6,516,575 | B2 * | 2/2003 | Haab | E05D 13/04<br>160/196.1 |
| 7,886,403 | B2 * | 2/2011 | Nezu | E05B 65/0858<br>16/87 R |
| 8,464,466 | B1 * | 6/2013 | Kunz | E05D 13/1276<br>16/193 |
| 8,640,383 | B1 * | 2/2014 | Kunz | E05D 15/22<br>49/181 |

* cited by examiner

SYSTEM AND METHOD FOR INHIBITING WINDOW SASH DRIFT

RELATED APPLICATIONS

The application claims the benefit of U.S. Provisional Patent Application No. 62/144,898, filed Apr. 8, 2015.

BACKGROUND OF THE INVENTION

1. Field of the Invention

In general, the present invention relates to counterbalance systems for windows that prevent open window sashes from moving under the force of their own weight. More particularly, the present invention system relates to the structure of both the brake shoe and window track stops that help inhibit the unintentional movement, known in the industry as drift, of a window sash during use.

2. Description of the Prior Art

There are many types and styles of windows. One of the most common types of window is the double-hung window. Double-hung windows are the window of choice for most home construction applications. A double-hung window consists of an upper window sash and a lower window sash. Either the upper window sash or the lower window sash can be selectively opened and closed by a person sliding the sash up and down within the window frame.

A popular variation of the double-hung window is the tilt-in double-hung window. Tilt-in double-hung windows have sashes that can be selectively moved up and down. Additionally, the sashes can be selectively tilted into the home so that the exterior of the sashes can be cleaned from within the home.

The sash of a double-hung window can be very heavy. The weight of the window sash depends upon both the materials used to make the window sash and the size of the window sash. Since the sashes of a double-hung window are free to move up and down within the frame of a window, some counterbalancing system must be used to prevent the window sashes from constantly moving to the bottom of the window frame under the force of their own weight.

Modern tilt-in double-hung windows are primarily manufactured in one of two ways. There are vinyl frame windows and wooden frame windows. In the window manufacturing industry, different types of counterbalance systems are traditionally used for vinyl frame windows than for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

The shoes contain a brake mechanism that is activated by the tilt post of the window sash when the window sash is tilted inwardly away from the window frame. The shoe therefore locks the tilt post in place and prevents the base of the sash from moving up or down in the window frame once the sash is tilted open. Furthermore, the brake shoes are attached to coil springs inside the guide tracks of the window assembly. Coil springs are constant force springs, made from a coiled length of metal ribbon. The coil springs supply the counterbalance force needed to suspend the weight of the window sash.

Small tilt-in windows have small, relatively light window sashes. Such small sashes may only require a single coil spring on either side of the window sash to generate the required counterbalance forces. However, due to the space restrictions present in modern tilt-in window assemblies, larger springs cannot be used for heavier window sashes. Rather, multiple small coil springs are ganged together to provide the needed counterbalance force. A large tilt-in window sash may have up to eight coil springs to provide the needed counterbalance force.

The coil springs used to counterbalance the weight of a window sash typically only approximate the weight of the window sash. Often, the upward force of the coil springs is slightly less than the downward force of gravity. A window manufacturer, therefore, relies on friction to retain the window in an open position. However, as windows wear, surfaces become smooth and friction can be significantly reduced. Accordingly, when a window sash is fully open, it may begin to drift closed without being touched. Furthermore, when an upper window sash is being opened, it creates friction against the lower window sash that it passes. If the lower window sash is opened, then the movement can cause the open upper window sash to drift closed.

A need therefore exists for a system and method that can prevent a window sash from drifting under the force of its own weight as friction forces vary over time. This need is met by the present invention as described and claimed below.

SUMMARY OF THE INVENTION

The present invention is a system and method for inhibiting inadvertent movement of a window sash out of a fully open position. The window sash is set in guide tracks that run along the sides of the overall window assembly. The window sash is a tilt-in window with pivot posts that engage brake shoes. The brake shoes travel up and down in the guide tracks as the window sash is moved between a fully open position and a fully closed position.

A stop is mounted within the guide tracks. The brake shoe and the stop contact and interconnect when the window sash is moved to its fully open position. The brake shoe is separable from the stop when a closing force is manually applied to the window sash that acts to move the window sash away from its fully open position. The force applied must exceed a threshold level. In this manner, the window sash will remain in its fully open position and will not inadvertently drift closed due to gravity, vibrations or contact with another window sash.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

The features of the present invention system can be incorporated into many window counterbalance designs. However, the embodiments illustrated show only two exemplary embodiments of the system for the purpose of description. The exemplary embodiments illustrated are selected in order to set forth two of the best modes contemplated for the invention. The illustrated embodiments, however, are merely exemplary and should not be considered a limitation when interpreting the scope of the appended claims.

Figure 1:
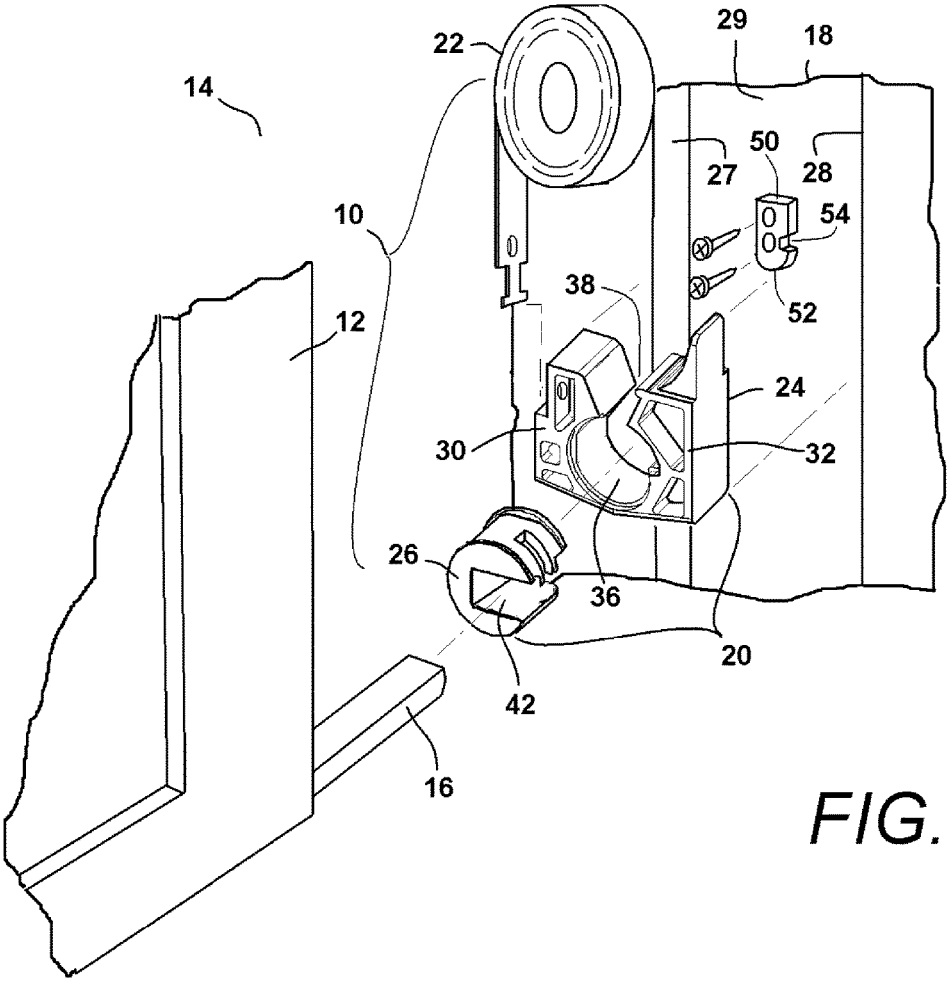
FIG. 1 is an exploded perspective view of a section of a tilt-in window assembly containing a counterbalance system in accordance with the present invention.
Figure 2:
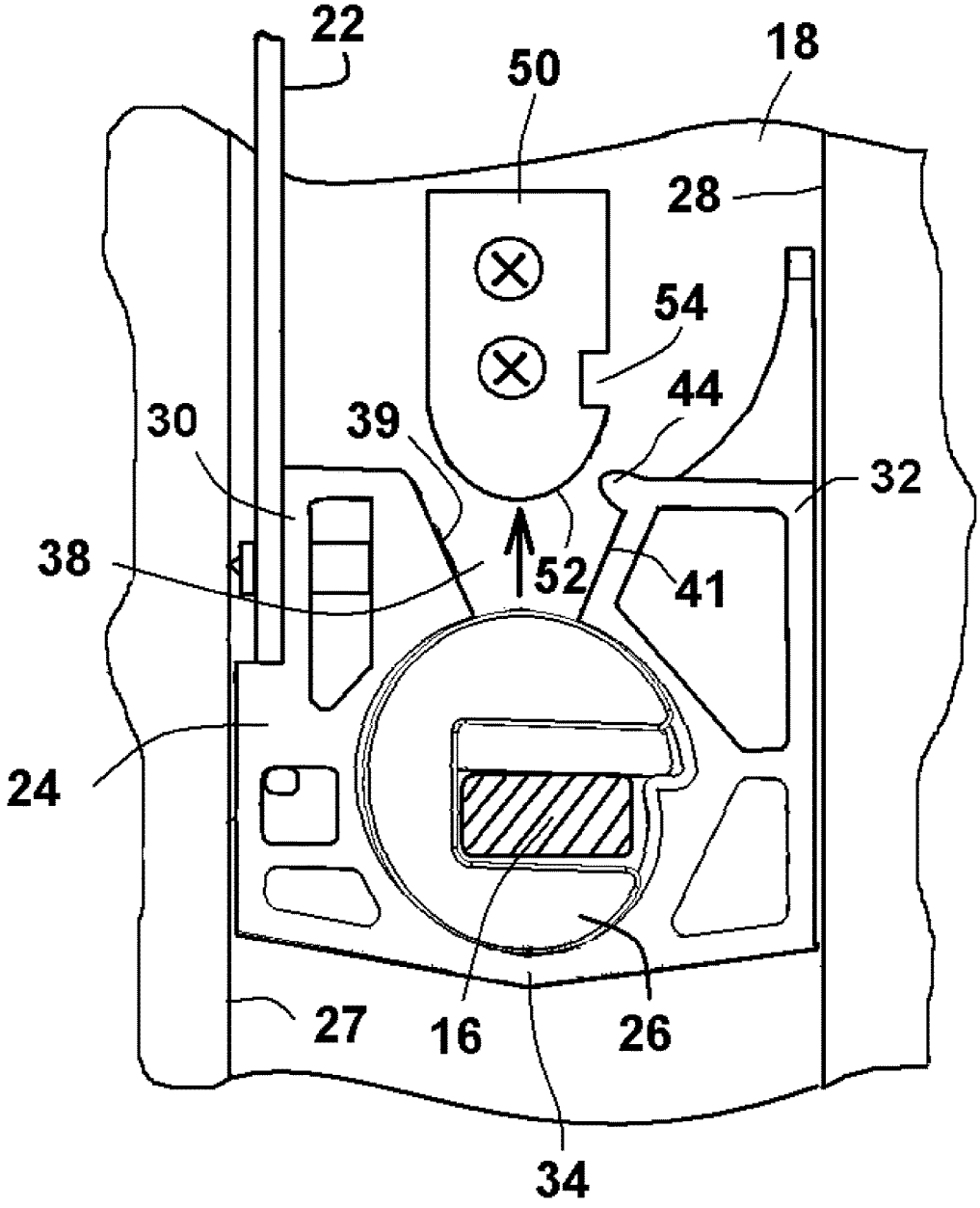
FIG. 2 is an end view of the embodiment of the system shown in FIG. 1, shown in an unengaged condition.

Referring to FIG. 1, in conjunction with FIG. 2, there is shown a first exemplary embodiment of a counterbalance system 10 that is used to counterbalance a window sash 12 contained within a window assembly 14. The window sash 12 is a tilt-in window sash and therefore has pivot posts 16 that extend laterally from the bottom of the window sash 12. Although only one pivot post 16 is illustrated, it will be understood that the window sash 12 is symmetrical and that a pivot post 16 extends from both sides of the window sash 12.

Each pivot post 16 extends into a brake shoe assembly 20. The brake show assembly 20 moves up and down in a guide track 18 on either side of the window sash 12. The brake shoe assembly 20 serves multiple functions. First, the brake shoe assembly 20 is designed to move smoothly within the guide trade 18. As such, the window sash 12 can open and close smoothly without binding or rattling. Second, the brake shoe assembly 20 engages the guide track 18 and holds the pivot post 16 of the window sash 12 in a fixed position, when the window sash 12 is tilted inwardly for cleaning or removal. Lastly, the brake shoe assembly 20 attaches to one or more coil springs 22 that are used to counterbalance the weight of the window sash 12. The coil springs 22 are mounted in the guide track 18 at some elevation above the brake shoe assembly 20. As such, the brake shoe assembly 20 and the window sash 12 it supports are biased upwardly by the coil springs 22.

Each brake shoe assembly 20 includes a brake shoe housing 24 and a cam element 26. The brake shoe housing 24 retains the cam element 26. The cam element 26 receives the pivot post 16 extending from the window sash 12. The brake shoe assembly 20 rides up and down in its guide track 18. Each guide track 18 has a rear wall 29 and two side walls 27, 28. The brake shoe assembly 20 is sized to be just narrow enough to fit between the side walls 27, 28 of the guide track 18 without causing excessive contact with the guide track 18 as the brake shoe assembly 20 moves up and down with the window sash 12.

The brake shoe housing 24 is plastic and is preferably unistructurally molded as a single unit that requires no assembly. The brake shoe housing 24 is generally U-shaped, having a first arm element 30 and a second arm element 32 that are interconnected by a thin bottom section 34. In the shown embodiment, the coil spring 22 attaches to the first arm element 30. In the preferred embodiment, the second arm element 32 has a length that is at least twenty-five percent longer than that of the first arm element 30. This prevents the coil spring 22 from being able to twist or cock within the brake shoe housing 24 in the guide track 18.

A generally circular cam opening 36 is formed between the first arm element 30, the second arm element 32 and the bottom section 34. Above the cam opening 36, the first arm element 30 and the second arm element 32 are separated by a gap space 38. The first arm element 30 has a first sloped surface 39 that faces the gap space 38. Likewise, the second arm element 32 has a second sloped surface 41 that faces the gap space 38. Taken together, the first sloped surface 39 and the second sloped surface 41 diverge away from each other as they ascend above the cam opening 36. The result is that the gap space 38 has tapered sides that lead toward the cam opening 36.

The cam element 26 is inserted into the cam opening 36. The cam element 26 receives the pivot post 16 from the window sash 12. The cam opening 36 and the cam element 26 are configured so that the cam element 26 will cause the cam opening 36 to enlarge as the cam element 26 rotates within the cam opening 36. The cam element 26 can be rotated by the pivot post 16 when the window sash 12 is tilted inwardly. When rotated, the cam element 26 spreads the first arm element 30 and the second arm element 32 apart. This is achieved by the elastic flexing of the thin bottom section 34 of the brake shoe housing 24, which acts as a living hinge. The first arm element 30 and the second arm element 32 engage the sides of the guide track 18 and lock the brake shoe assembly 20 in place within the guide track 18.

A locking projection 44 is formed on one of the two sloped surfaces 39, 41. In the shown embodiment, the locking projection 44 is formed on the second sloped surface 41. However, this position is arbitrary and its position can be reversed to be formed on the first sloped surface 39.

A catch stop 50 is provided. The catch stop 50 is a small shaped body that is mounted to the rear wall 29 of the guide track 18. The catch stop 50 is positioned in the guide track 18 so that the brake shoe assembly 20 contacts and interconnects with the catch stop 50 when the window sash 12 is in its fully open position.

The catch stop 50 has a curved head 52 and a catch relief 54 along one side adjacent to the curved head 52. The curved head 52 of the catch stop 50 is sized to pass into the gap space 38 between the first sloped surface 39 and the second sloped surface 41 as the window sash 12 is fully opened. As the window sash 12 is opened, the brake shoe assembly 20 moves up the guide track 18 until it contacts the catch stop 50. As the window sash 12 reaches its fully open position, the catch stop 50 advances between the sloped surfaces 39, 41 of the first arm element 30 and the second arm element 32.

Figure 3:
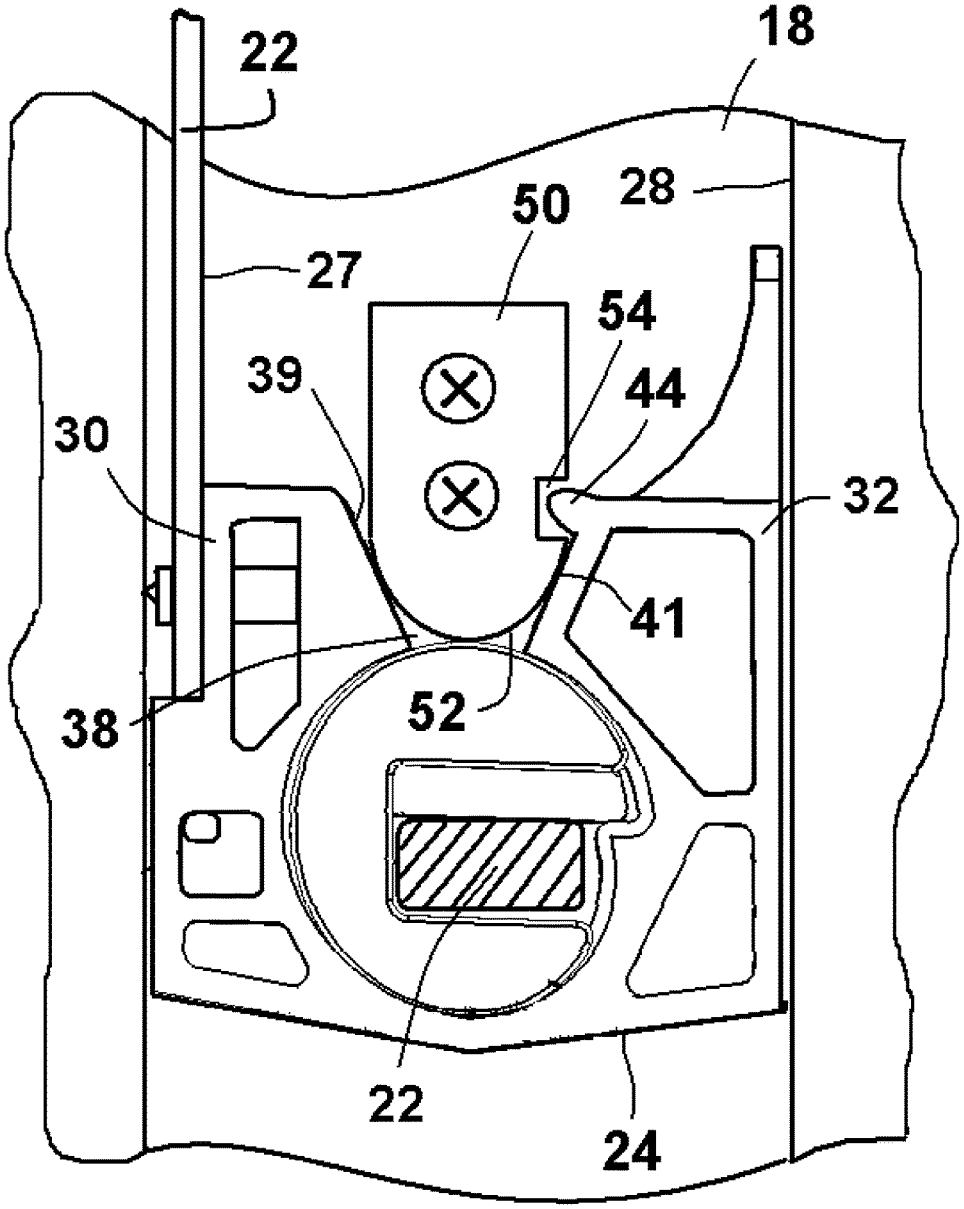
FIG. 3 is an end view of the embodiment of the system shown in FIG. 2, shown in an engaged condition.

Referring to FIG. 3 in conjunction with FIG. 2 and FIG. 1, it can be understood that the initial contact between the locking projection 44 and the curved head 52 of the catch stop 50 causes the gap space 38 to spread. This makes it a little harder to move the window sash 12, since the brake shoe assembly 20 is engaging the guide track 18 with increased force. This provides a tactile indication to a person that the window sash 12 is almost at its fully open position. Upon a slight further opening, the locking projection 44 advances into the catch relief 54.

The presence of the locking projection 44 in the catch relief 54 creates a mechanical interconnection between the brake shoe assembly 20 and the catch stop 50. The mechanical interconnection is sufficient to prevent the window sash 12 from drifting, due to gravity or contact with another window sash. However, the mechanical connection is tenuous. The mechanical connection can easily be overcome by manually applying a downward force of a few pounds to the window sash 12. The preferred force is between one and five pounds. Such a downward force will pull the brake shoe assembly 20 free of the catch stop 50, wherein the window functions in the traditional manner.

The locking projection 44 and/or the catch relief 54 can have angled surfaces that facilitate the separation of the locking projection 44 from the catch relief 54 as a downward force is applied to the window sash 12. The angled surfaces prevent binding and excessive wear between the locking projection 44 and the catch relief 54.

Referring to all figures, it will be understood that to utilize the present invention, the catch stops 50 are mounted into the guide tracks 18 of the window assembly 14. Likewise, the brake shoe assemblies 20 of the present invention are used in the counterbalance system. As the window sash 12 is opened, the brake shoe assemblies 20 move toward the catch stops 50. As the window sash 12 reaches its fully open position, the brake shoes assemblies 20 contact and interconnect with the catch stops 50. The locking projections 44 on the brake shoes assemblies 20 enter the catch reliefs 54 in the catch stops 50, therein creating a mechanical interconnection between the brake shoe assemblies 20 and the catch stops 50. The mechanical interconnection is strong enough to prevent the window sash 12 from drifting closed. However, once a downward force of a few pounds is applied to the window sash 12, the mechanical interconnection releases and the window sash 12 is free to close in the normal manner.

Figure 4:
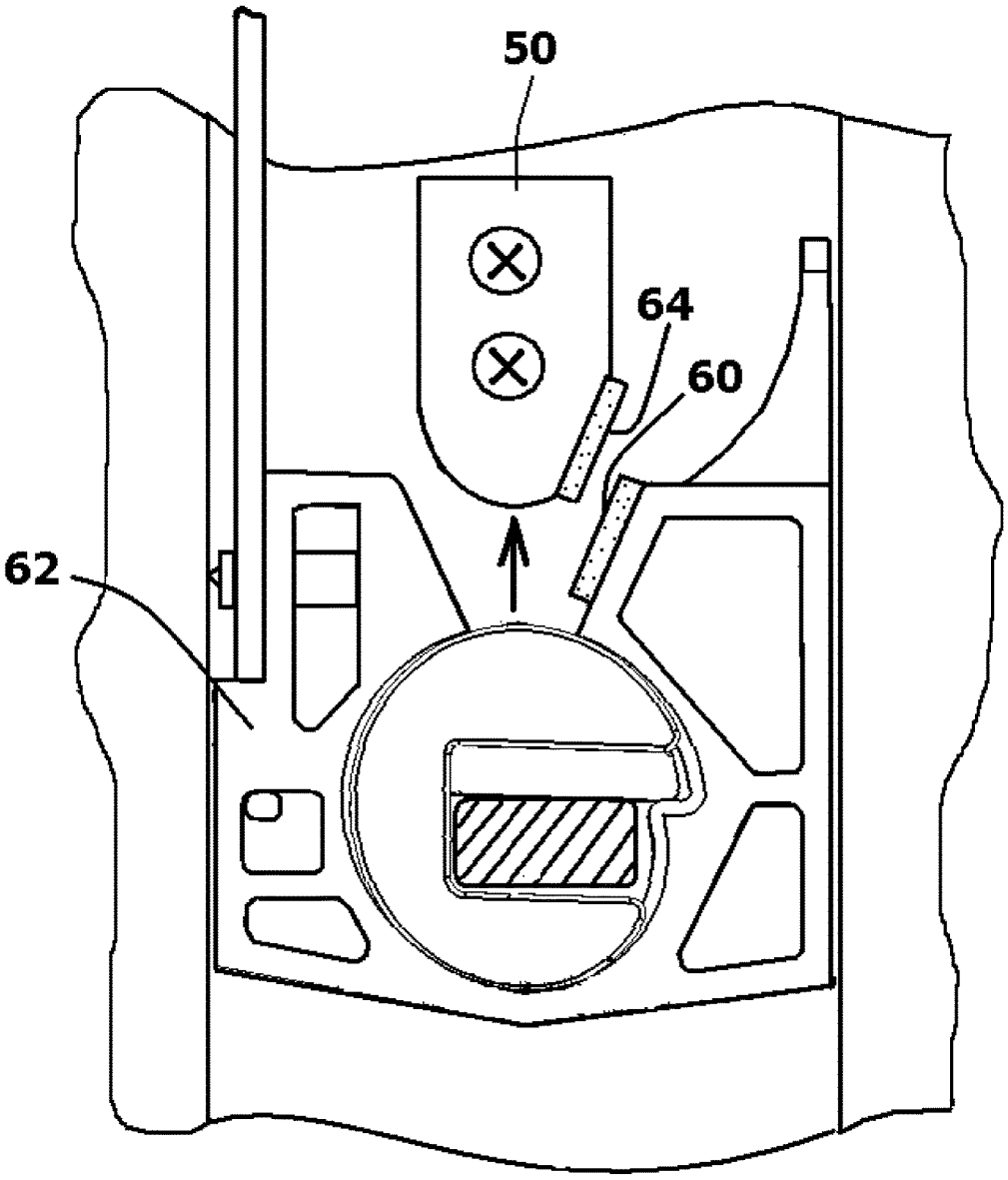
FIG. 4 is an end view of an alternate embodiment of the system, shown in an engaged condition.

The connection between the catch stop 50 and the brake shoe assembly 20 can be made in many ways. There are many alternative mechanical connections, such as pawls or detents, that can create a similar temporary interconnection. Alternatively, a magnetic connection can also be used in place of the mechanical interconnection. Referring to FIG. 4, such an alternate embodiment is shown. In FIG. 4, magnets 60 are coupled to the brake shoe assembly 62. Magnets 64 of the opposite polarity or ferromagnetic plates are coupled to a catch stop 50. As the brake shoe assemblies 62 contact the catch stop 50, there is a magnetic interconnection created between the magnets 60, 64. The strength of the interconnection can be engineered by controlling the strength, size and location of the magnets 60, 64. Preferably the magnetic connection is engineered to create an attraction force of between one and five pounds. In this manner, the magnetic connection can be undone by simply applying a slight downward force to the window sash and separating the magnets 60, 64.

It will be understood that the embodiments of the present invention system that are described and illustrated herein are merely exemplary and a person skilled in the art can make many variations to the embodiments shown without departing from the scope of the present invention. All such variations, modifications, and alternate embodiments are intended to be included within the scope of the present invention as defined by the claims.

What is claimed is:

1. In a window having a window sash that travels in guide tracks as said window sash moves between a fully open position and a fully closed position, a system for inhibiting drift movement of said window sash out of said fully open position, said system comprising:

a brake shoe coupled to said window sash that moves in one of said guide tracks, wherein said brake shoe has a first arm, a second arm, and a gap space between said first arm and said second arm;

a stop mounted to said one of said guide tracks at a fixed elevation, wherein said stop widens said gap space and further separates said first arm from said second arm as said stop enters said gap space and contacts said brake shoe, therein causing said brake shoe and said stop to remain in contact and form a mechanical interconnection as said window sash reaches said fully open position, the stop directly contacting the brake shoe when the window sash is in said fully open position, wherein said mechanical interconnection opposes a force applied to said window sash to move said sash from said fully open position towards said fully closed position.

2. The system according to claim 1, wherein said force is up to five pounds.

3. The system according to claim 1, wherein said stop defines a relief and said brake shoe has a projection that enters said relief to create said mechanical interconnection when said window sash is in said fully open position.

4. The system according to claim 1, further including at least one counterbalance spring that biases said brake shoe toward said stop.

5. In a window having a window sash that can move in guide tracks between a fully open position and a fully closed position, a system for inhibiting inadvertent movement of said window sash out of said fully open position, said system comprising:

a brake shoe coupled to said window sash that moves in one of said guide tracks, wherein said brake shoe has a gap space formed therein;

a stop mounted within said one of said guide tracks, wherein said stop enters and widens said gap space causing said brake shoe to be biased against said stop until said window sash reaches said fully open position and said brake shoe and said stop mechanically interconnect with the stop directly contacting the brake shoe when the window sash is in said fully open position, and wherein said brake shoe is separable from said stop when a closing force is manually applied to said window sash that acts to move said window sash toward said fully closed position.

6. The system according to claim 5, wherein said closing force is between one and five pounds.

7. The system according to claim 5, wherein said stop defines a relief and said brake shoe has a projection that enters said relief when said window sash is in said fully open position.

8. The system according to claim 5, further including at least one counterbalance spring that biases said brake shoe toward said stop.

9. The system according to claim 5, wherein said brake shoe has a first arm, an opposite second arm and said gap space is disposed between said first arm and said second arm.

10. The system according to claim 9, wherein said stop widens said gap space and further separates said first arm from said second arm on said brake shoe when said stop enters said gap space on said brake shoe.

* * * * *